US005427230A

United States Patent [19]

Mattox

[11] Patent Number: 5,427,230

[45] Date of Patent: Jun. 27, 1995

[54] JEWELRY HOLDER AND ORGANIZER

[75] Inventor: Kathleen R. Mattox, Sunfish Lake, Minn.

[73] Assignee: Sunfish, Inc., Sunfish Lake, Minn.

[21] Appl. No.: 254,631

[22] Filed: Jun. 8, 1994

[51] Int. Cl.[6] ..... B65D 73/00

[52] U.S. Cl. ..... 206/6.1; 206/478; 206/495

[58] Field of Search ..... 206/58.1, 6.1, 466, 206/477, 478, 479, 483, 495, 348; 383/38

[56] References Cited

U.S. PATENT DOCUMENTS

| | | | |
|---|---|---|---|
| 4,401,219 | 8/1983 | Mask | 206/466 X |
| 4,773,535 | 9/1988 | Cook | 383/38 X |
| 4,958,727 | 9/1990 | Bergeron | 206/6.1 |
| 5,050,745 | 9/1991 | Sanders | 206/495 X |
| 5,121,833 | 6/1992 | Lindsay et al. | 206/6.1 |
| 5,141,113 | 8/1992 | Elliott | 206/495 X |
| 5,209,344 | 5/1993 | Smith | 206/6.1 |
| 5,246,103 | 9/1993 | Hicks | 206/495 X |
| 5,259,497 | 11/1993 | Brothers et al. | 206/6.1 |
| 5,261,529 | 11/1993 | Holland | 206/6.1 |
| 5,295,587 | 3/1994 | Downes et al. | 206/6.1 X |

OTHER PUBLICATIONS

Apr. 1994 Catalog, "Hold Everything", p. 9, item 10, Hold Everything.

Label for "My Earring Thing" organizer, B. L. H. Enterprise, dated 1991.

*Primary Examiner*—Jacob K. Ackun, Jr.

*Attorney, Agent, or Firm*—Merchant, Gould, Smith, Edell, Welter & Schmidt

[57] ABSTRACT

Disclosed is a jewelry holder 10 for organizing earrings 27, necklaces 30, bracelets 31, and other items of jewelry. The jewelry holder 10 has a flexible mesh sheet 11 with a plurality of apertures 12. The jewelry holder 10 is hung from a clothes hanger 13 or other suitable rod by a pair of mounting strips 14. Fabric segments 20 support jewelry such as clip-on earrings, and lower support straps 23 accommodate other items of jewelry such as necklaces and bracelets. Also disclosed is a method for displaying and organizing jewelry.

17 Claims, 2 Drawing Sheets

JEWELRY HOLDER AND ORGANIZER

FIELD OF THE INVENTION

The present invention relates generally to containers for small items, and more particularly to containers for displaying and organizing jewelry.

BACKGROUND OF THE INVENTION

Jewelry is typically stored in a jewelry box or in a drawer. As a result, the jewelry may become tangled, and particular items of jewelry may be difficult to locate. Additionally, these storage methods make it difficult for jewelry owners to evaluate their options when selecting or itemizing jewelry.

Prior attempts to organize jewelry have been numerous but inadequate. Currently available jewelry holders include a rigid plastic member having holes to accommodate pierced earrings, and rigid plastic members having U-shaped slots to hold necklaces. Additionally, jewelry holders having a series of pouches are commercially available, however, it is difficult for the jewelry owner to clearly see the contents of each pouch, even when the pouch is made of a clear plastic material. The pouches are particularly unsuitable for small or dainty jewelry, such as small earrings. These items become "lost" in the relatively large pouch and are difficult if not impossible to see. Furthermore, certain jewelry can become tangled within the pouch.

The difficulties with prior jewelry holders are that they are unable to accommodate all different types of jewelry, and they are unable to display the jewelry in such a manner so that the jewelry owner can see everything. Being able to clearly view several items of jewelry is important, so that the jewelry owner does not overlook an item in the jewelry collection, and so that the different items of jewelry may be coordinated depending upon the particular outfit worn, or the jewelry owner's preference on that particular day.

The present invention addresses these and other problems associated with currently available jewelry containers.

SUMMARY OF THE INVENTION

The present invention is a jewelry holder, comprising a flexible mesh sheet, the upper portion of which has mounting means; a plurality of fabric strips attached to the front face of the mesh sheet; and a plurality of bottom support straps, preferably being releasably attachable by a hook and loop fastener material. Preferably, the jewelry holder mounting means comprise a pair of mounting strips for attaching the jewelry holder to a clothes hanger or other suitable support structure. Another aspect of the invention is a method for displaying and organizing jewelry, including the steps of mounting a jewelry holder (of the type described above) upon a clothes hanger, and attaching various types of jewelry to desired locations on the jewelry holder. A particular advantage of the present invention is that all types of jewelry can be displayed by the jewelry holder, including: 1) pierced earrings with separate backings, 2) pierced earrings with permanently attached backings, 3) clip earrings, 4) necklaces, 5) bracelets, 6) pins, 7) rings, 8) hair clips, and 9) other types of jewelry. The present invention would also be suitable for holding or displaying other types of products, such as hardware, medals, etc. A particular advantage of the present invention is that the jewelry may be displayed at a variety of locations on the jewelry holder, and the jewelry can be mounted upon the jewelry holder regardless of its size and shape. This feature results from the random position of the jewelry holder's apertures. That is, a portion of the jewelry can be inserted within the appropriate apertures at any desired place on the jewelry holder, and the user need not try to contend with a fixed, rigid aperture pattern. Another feature of the present invention is that it allows the jewelry to be clearly displayed. The jewelry owner is able to survey the entire collection of jewelry simultaneously, to facilitate the evaluation of jewelry options. Furthermore, the jewelry is not contained within an opaque or transparent container, so the jewelry owner can easily see the true color and texture of the various jewelry pieces.

Yet another feature of the present invention is that it may be hung from a clothes hanger, and the jewelry can be stored in the user's closet. This provides some additional protection against theft of the jewelry, because a burglar would typically search a jewelry box or drawer for such items, but would not be as likely to search for jewelry in a closet.

Still another advantage of the present invention is that it is flexible and portable. The jewelry organizer may be placed in various locations, such as in a closet, mounted from the top surface of a door, against a bureau, and mounted upon a bureau knob, or wherever convenient. In the event that the jewelry owner desires to transport jewelry, the jewelry holder can simply be rolled or folded into a compact bundle for travel. For a better understanding of the invention, and of the advantages attained by its use, reference should be made to the drawings and accompanying descriptive matter, in which there is illustrated and described a preferred embodiment of the invention.

BRIEF DESCRIPTION OF THE DRAWINGS

Referring to the drawings, wherein like reference numerals indicate like parts throughout the several views.

DETAILED DESCRIPTION OF THE PREFERRED EMBODIMENT

Figure 1:
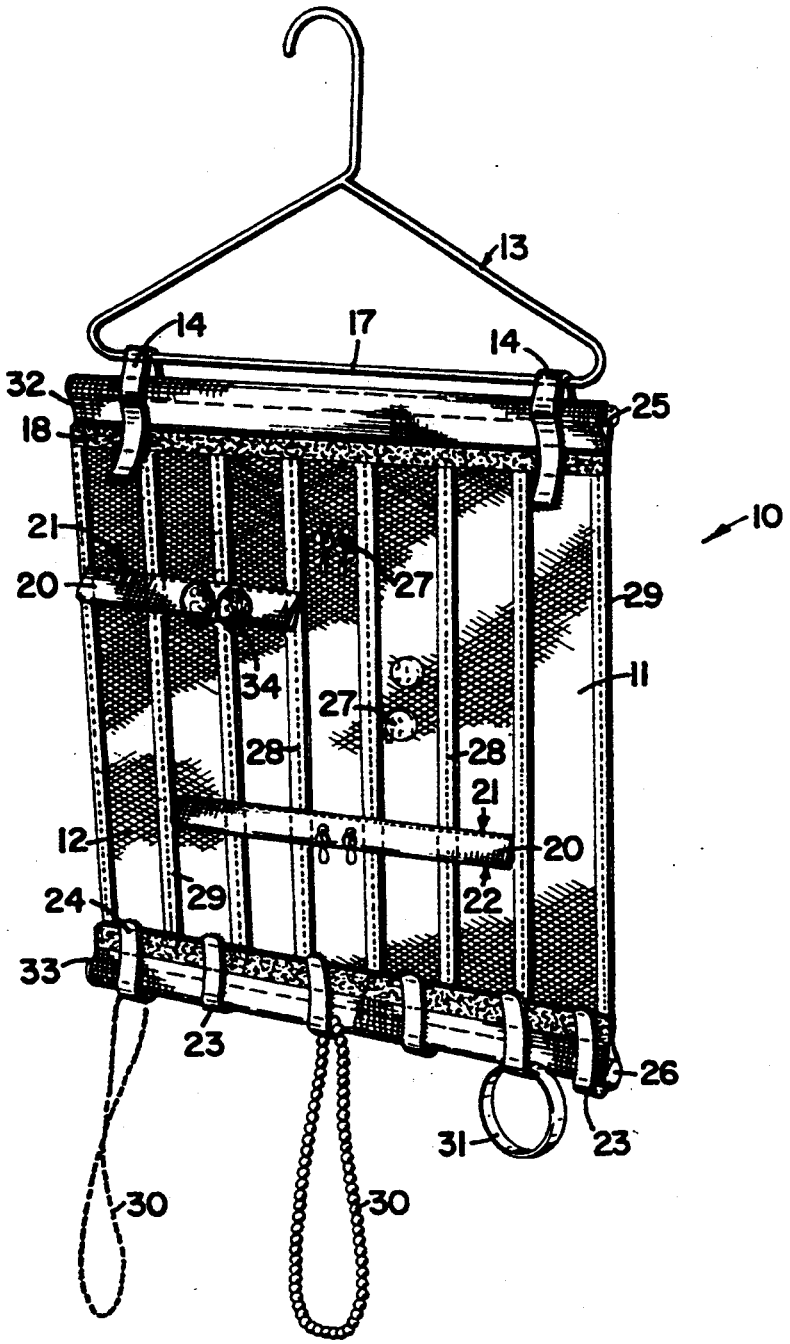
FIG. 1 is a perspective view of the jewelry holder and organizer of the present invention.
Figure 2:
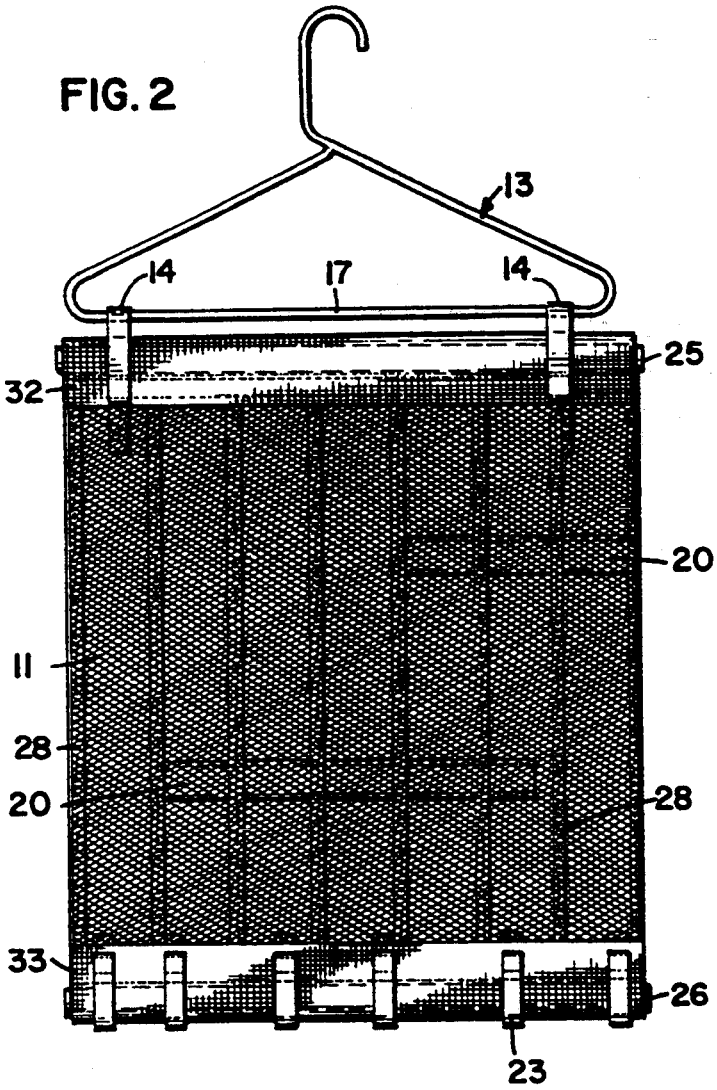
FIG. 2 is a rear elevational view of the jewelry holder and organizer illustrated in FIG. 1.

The jewelry holder of the present invention is illustrated generally at 10. The jewelry holder 10 includes a flexible mesh sheet 11 having a plurality of apertures 12. In the preferred embodiment, the apertures are in a continuous honeycombed pattern. Preferably, there are approximately eight apertures 12 per lineal inch, and the apertures 12 are hexagonal in shape. The mesh sheet 11 is preferably a "two-ply" sheet, i.e., there are two overlaying sheets of mesh material in an abutting relationship. The plies are rectangular sheets of mesh material of the same size. However, the jewelry holder 10 illustrated in the Drawings shows the mesh sheet 11 to be only a single ply, for purposes of clarity.

The aperture pattern and the presence of two mesh sheets result in a jewelry holder which is able to support almost any type of jewelry item, regardless of its shape and size. The user may insert an earring post, for example, in any convenient aperture. The flexibility of the dual mesh sheets results in a plurality of apertures being available to the user at any random location. Additionally, the presence of two mesh sheets provides additional structural stability and durability as compared to a single mesh sheet.

In the preferred embodiment, the jewelry holder 10 is mounted to a clothes hanger 13. Alternatively, the jewelry holder 10 could be mounted on a clothes rod in a closet, a towel bar, or other suitable support member. In the preferred embodiment, the hanger 13 is made of a rigid plastic material.

Proximate the upper portion of the jewelry holder 10 is a mounting means for attaching the jewelry holder 10 to the clothes hanger or other support member. Preferably, the mounting means comprises a pair of strips 14, each strip having a permanently attached end 15 (see FIG. 3) and a releasable end 16. The mounting strips 14 form a loop around the horizontal rod 17 of the clothes hanger 13. The releasable end 16 of the mounting strips 14 preferably includes hook and loop fastener material 19, such as that sold under the trademark Velcro TM. The upper portion of the jewelry holder 10 includes a horizontal strip 18 of hook and loop fastener material which mates with the releasable end 16 of the mounting strips 14. As an alternative to a continuous horizontal strip 18, the jewelry holder 10 could have a plurality of square segments of hook and loop fastener material, each segment being in alignment with a mounting strip 14 and being of sufficient size to accommodate a mounting strip 14.

The jewelry holder 10 has a plurality of fabric segments 20 attached to the mesh panel or sheet 11. In the embodiment illustrated in the Drawings, there are two horizontal fabric segments 20. The segments 20 are preferably looped, so as to have a pair of inner edges 21 which are attached to the mesh sheet 11 and a central, outer portion 22 which is free from the sheet 11. In this manner, the segments 20 extend slightly outwardly from the front surface of the mesh sheet 11. The segments 20 are suitable for mounting items such as clip earrings 34. It is to be understood that the jewelry holder 10 could have more fabric segments 20 than the two segments 20 shown on the illustrated embodiment. On the other hand, the jewelry holder could be provided without any fabric segments 20.

In the preferred embodiment, the material utilized for the loops 20 and flaps of material 32, 33 is a relatively heavy material such as suede, velvet, a foam material, etc. In the preferred embodiment, a material sold under the Ultrasuede TM trademark is used. These types of materials are thick enough to prevent the clip earrings 34 from falling off.

The jewelry holder 10 also has a plurality of support straps 23 proximate the bottom portion of the jewelry holder. The support straps 23 are similar in construction to the mounting strips 14. Each support strap 23 has a permanently attached end and a releasable end. In the preferred embodiment, each support strap 23 has a hook and loop fastener material which releasably mates with a horizontal strip 24 of hook and loop fastener material which extends across the bottom portion of the jewelry holder 10. As an alternative to the continuous horizontal strip 24, the jewelry holder 10 could have a plurality of hook and loop fastener segments, each of which is in alignment with a support strap 23 and which is of a suitable size to mate with the support strap 23. Furthermore, hook and loop devices could be sewn onto the jewelry holder 10 instead of utilizing the hook and loop fastener material. Another alternative to the hook and loop fastener material would be the use of support straps 23 which are held in their looped configuration by ties.

The straps 23 at the bottom of the jewelry holder 10 allow the organization of necklaces 30 and bracelets 31. In the preferred embodiment, one or more of the straps 23 may be relatively narrow, so as to accommodate rings (not shown). For example, two different widths of support straps 23 could be provided: wider straps 23 for bracelets 31 and necklaces 30, and narrower straps 23 for rings.

There are two horizontal dowels 25, 26 in the upper and lower portions of the jewelry holder respectively. The dowels 25, 26 are preferably circular in cross section and made of a wood material. The dowels 25, 26 have a length which equals the width of the jewelry holder 10, and they provide shape and stability to the jewelry holder 10. The dowels 25, 26 could also be of a relatively flat configuration, rather than circular in cross section, and the dowels 25, 26 could be made of a metal or plastic material, rather than wood.

The mesh material 11 has enough strength and durability as to be able to support jewelry items such as pierced earrings 27. The post of the earrings is inserted through the mesh material, and the earring back is attached onto the post from the rear side of the jewelry holder 10. With this design, the earrings 27 (or other item of jewelry) may be placed anywhere on the mesh panel 11 that the user desires, and the earrings can be organized in any desired manner.

In the preferred embodiment, the jewelry holder 10 has a plurality of vertical seam lines 28. Overlaying the seam lines 28 are a series of vertical fabric bands 29. In the preferred embodiment, the fabric bands 29 are made of a material such as satin. The sewn seams 28 interconnect the two plies of the mesh panel 11 and the fabric band 29. Preferably, the bands 29 are positioned on the front face of the jewelry holder 10 in a manner which provides an aesthetically pleasing appearance. The bands 29 could be horizontal, vertical and/or at an angle with respect to the edges of the jewelry holder 10. Alternatively, the jewelry holder 10 could be provided without any fabric bands 29.

The jewelry holder 10 can be provided in various sizes and shapes. One preferred size of the jewelry holder 10 is approximately eighteen inches by twenty-four inches. Alternatively, the jewelry holder 10 may be much smaller, in order to facilitate portability for travel, such as six inches by six inches. With the smaller embodiment, the jewelry holder 10 could be provided without any dowels 25, 26.

Figure 3:
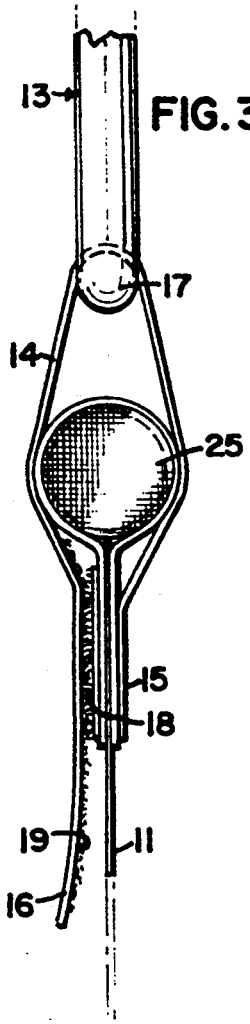
FIG. 3 is an enlarged, side elevational view of the upper portion of the jewelry holder and organizer illustrated in FIGS. 1 and 2.

Reinforcing fabric panels 32, 33 are positioned at the upper and lower portions of the mesh sheet 11. The panels of fabric 32, 33 extend around each dowel 25, 26 respectively. The fabric panels 32, 33 provide reinforcement for the jewelry holder 20 as well as a suitable surface for mounting of the Velcro TM strips 18, 24 respectively. The manner in which the fabric panel 32 wraps around the upper dowel 25 and extends downwardly on the upper portion of the jewelry holder 10 is illustrated in FIG. 3. Preferably, the panels 32, 33 are made of the same material utilized for the segments of fabric 20, preferably an Ultrasuede TM material.

In operation, the jewelry holder of the present invention can be used with all types of jewelry, including pierced earrings, clip-on earrings, pins, necklaces, rings and bracelets. The jewelry holder 10 is mounted upon a clothes hanger 13 or other suitable bar by means of the mounting strips 14 which attach to the Velcro TM strip 18. The user can then attach the various pieces of jewelry to the jewelry holder 10. Pierced earrings 27 and pins may be attached to the mesh panel 11, and clip-on earrings 34 may be attached to the fabric loops 20. Bracelets, necklaces and rings may be hung from the straps 23 at the bottom of the jewelry holder 10.

The various items of jewelry can be placed wherever desired and organized in a myriad of different ways. For example, a pin may be mounted anywhere upon the mesh panel 11. The continuous and random placement of the multiple apertures accommodate any size or shape of pin, and the user can easily adjust the position of an aperture, so that the pin can be inserted through the mesh panel 11. If the jewelry holder 10 is hung from a clothes hanger 13, the jewelry holder 10 can easily be stored in a closet and moved to other locations easily. In the event that the jewelry must be stored for travel, the jewelry holder 10 can be removed from the hanger 13 and rolled into a compact cylinder before being placed in a suitcase.

It is to be understood that numerous and various modifications can be readily devised in accordance with the principals of the present invention by those skilled in the art without departing from the spirit and scope of the invention. Therefore, it is not desired to restrict the invention to the particular construction illustrated and described but to cover all modifications that may fall within the scope of the appended claims.

What is claimed is:

1. A jewelry holder for jewelry of the type such as pierced earrings, clip-on earrings, pins, necklaces, rings and bracelets, the jewelry holder comprising:

a) a flexible mesh sheet, an upper portion of said sheet having mounting means, said sheet having a front face and a rear face, said mesh sheet having a plurality of apertures, wherein said apertures can be adjusted to a desired position for mounting of said jewelry; and b) a plurality of support straps proximate a bottom portion of said sheet, said support straps including hook and loop fastener material for attachment with hook and loop fastener material on the front face of said sheet.

2. The jewelry holder according to claim 1, further comprising a clothes hanger, said mounting means being attached to said clothes hanger.

3. The jewelry holder according to claim 2, further comprising a plurality of fabric segments operatively attached to said front face of said mesh sheet and extending outwardly therefrom, wherein said fabric segments are made of a suede material.

4. The jewelry holder according to claim 3, further comprising a pair of horizontal dowels proximate said upper and lower portions of said sheet.

5. The jewelry holder according to claim 2, further comprising a plurality of reinforcement bands operatively attached to said sheet.

6. The jewelry holder according to claim 5, wherein said mesh sheet has approximately eight apertures per lineal inch.

7. The jewelry holder according to claim 6, wherein said apertures are hexagonal in shape.

8. The jewelry holder according to claim 5, wherein said reinforcement bands are made of a satin material.

9. The jewelry holder according to claim 5, wherein said mesh sheet comprises a pair of opposed mesh panels, said panels being attached by a plurality of sewn seams.

10. The jewelry holder according to claim 2, wherein said mounting means comprises a pair of mounting strips including hook and loop fastener material.

11. A jewelry holder for jewelry of the type such as pierced earrings, clip-on earrings, pins, necklaces, rings and bracelets, the jewelry holder being attached to a clothes hanger and having an upper portion and a lower portion, the jewelry holder comprising:

a) a pair of flexible front and rear mesh sheets, said front and rear sheets being operatively attached in an abutting relationship;

b) a pair of mounting strips proximate said upper portion of said jewelry holder, each strip having a permanently attached end, and an opposite, releasably attached end;

c) a plurality of fabric segments operatively attached to said mesh sheets, said fabric segments being made of a suede material; and d) a plurality of support straps proximate said lower portion of said jewelry holder, each strap having a permanently attached end and an opposite, releasably attached end.

12. The jewelry holder of claim 11, further comprising a plurality of vertical reinforcement bands which lay against said front sheet, a sewn seam interconnecting each of said vertical reinforcement bands and said mesh sheets.

13. The jewelry holder of claim 12, wherein said front and rear mesh sheets have approximately eight apertures per lineal inch.

14. The jewelry holder according to claim 13, wherein said apertures are hexagonal in shape.

15. The jewelry holder according to claim 12, wherein said reinforcement bands are made of a satin material.

16. A method of displaying and organizing jewelry of the type such as pierced earrings, clip-on earrings, pins, necklaces, rings and bracelets, the method comprising the steps of:

a) mounting a jewelry holder upon a clothes hanger by means of a pair of strips having a hook and loop fastener material, said jewelry holder including:

i) a flexible mesh sheet, an upper portion of said sheet having mounting means, said sheet having a front face and a rear face;

ii) a plurality of fabric segments operatively attached to said front face of said mesh sheet and extending outwardly therefrom; and iii) a plurality of support straps proximate a bottom portion of said sheet, said support strips including hook and loop fastener material for attachment with hook and loop fastener material on the front face of said sheet; and b) attaching jewelry to said jewelry holder by attaching pierced earrings to said mesh sheet, attaching clip-on earrings to said fabric segments, and attaching necklaces, bracelets and rings to said support straps.

17. The method according to claim 16, further comprising the steps of:

a) removing said jewelry holder from said clothes hanger; and b) rolling said jewelry holder to a compact cylindrical configuration.

* * * * *